United States Patent [19]

Hayles et al.

[11] Patent Number: 4,663,618

[45] Date of Patent: May 5, 1987

[54] ARBITRARY RASTER BLANKING CIRCUIT

[75] Inventors: Donald G. Hayles; Mark N. Hepworth, both of Cedar Rapids, Iowa

[73] Assignee: Rockwell International Corporation, El Segundo, Calif.

[21] Appl. No.: 564,807

[22] Filed: Dec. 22, 1983

[51] Int. Cl.[4] ..... G09G 1/14

[52] U.S. Cl. ..... 340/732; 340/709; 315/365; 315/377

[58] Field of Search ..... 340/706, 707, 709, 710, 340/732; 178/18; 315/365, 377

[56] References Cited

U.S. PATENT DOCUMENTS 3,835,464 9/1974 Rider ..... 340/710
4,348,667 9/1982 Williams et al. ..... 340/706
4,354,185 10/1982 Worborschil ..... 340/709
4,355,805 10/1982 Baer et al. ..... 340/709
4,454,507 6/1984 Srinivasan et al. ..... 340/709

*Primary Examiner*—Gerald L. Brigance
*Assistant Examiner*—Jeffery Brier
*Attorney, Agent, or Firm*—Robert C. Mayes; George A. Montanye; H. Fredrick Hamann

[57] ABSTRACT

An apparatus is disclosed for displaying arbitrary forms on a raster-scanned cathode ray tube converting the analog X and Y deflection voltages of the raster signal directly into a digital TTL level blanking signal. The circuit designer, utilizing cartesian or polar coordinates, specifies a desired shape and its location utilizing the appropriate formulas. In this manner, a number of raster cut-out circuits are readily coupled to define a desired number of arbitrary shapes on a raster scanned cathode ray tube.

1 Claim, 2 Drawing Figures

ARBITRARY RASTER BLANKING CIRCUIT

BACKGROUND OF THE INVENTION

This invention relates to raster scanned cathode ray tubes and more specifically to electronic circuits for controlling the raster scan deflection of cathode ray tubes for displaying arbitrary forms thereon.

Raster scanned cathode ray tubes (CRTs) have been utilized to display a variety of pictures and forms in response to modulated video display signals in televisions and oscilloscopes, for example. In special use CRTs, such as in avionics equipment and medical technology displays, a need has been observed to display both constant forms and varying data and forms in response to changing conditions. The constant forms may be required to be generated essentially simultaneously with the varying data, or may be generated as a "framework" around which the varying data is displayed relative to the constant forms.

One problem which has been observed is the expensive memory capability required to store the software necessary to display these constant forms when utilizing a digitally-operated and microprocessor-controlled cathode ray tube.

SUMMARY AND BRIEF DESCRIPTION

Accordingly, it is an object of the present invention to provide a raster blanking circuit capable of defining arbitrary forms on a cathode ray tube, thereby eliminating software storage requirements for constant forms required by the display.

Another object of the present invention is to provide a circuit for displaying arbitrary forms on a raster scanned cathode ray tube in a constant manner as a coordinate function relative to a specified reference point on said display, thereby increasing software storage capability for alternative purposes and functions in a microprocessor-controlled cathode ray tube apparatus.

Briefly, and in accordance with the present invention, an apparatus for displaying arbitrary forms on a raster scanned cathode ray tube display independent of scan frequency is provided, comprising: means for designating a specified reference point on the display, the reference point having predetermined X and Y axis deflection voltage constants, respectively; means in cooperation with the means for designating and coupled thereto for sensing operational analog X and Y deflection voltages relative to the reference point voltage constants; and means coupled to the means for sensing for digitally controlling the cathode ray tube display in response thereto and as a predetermined logic function of the sensed voltage, the logic function defining a specified form and location on the display. The predetermined logic function may be either a cartesian coordinate relationship or a polar coordinate relationship to the specified reference point, and defined by specific hardware implementation as is shown and described herein.

Further objects and advantages of the present invention will become obvious upon reference to the specification in conjunction with the drawings in which.

DETAILED DESCRIPTION OF THE INVENTION

Figure 1:
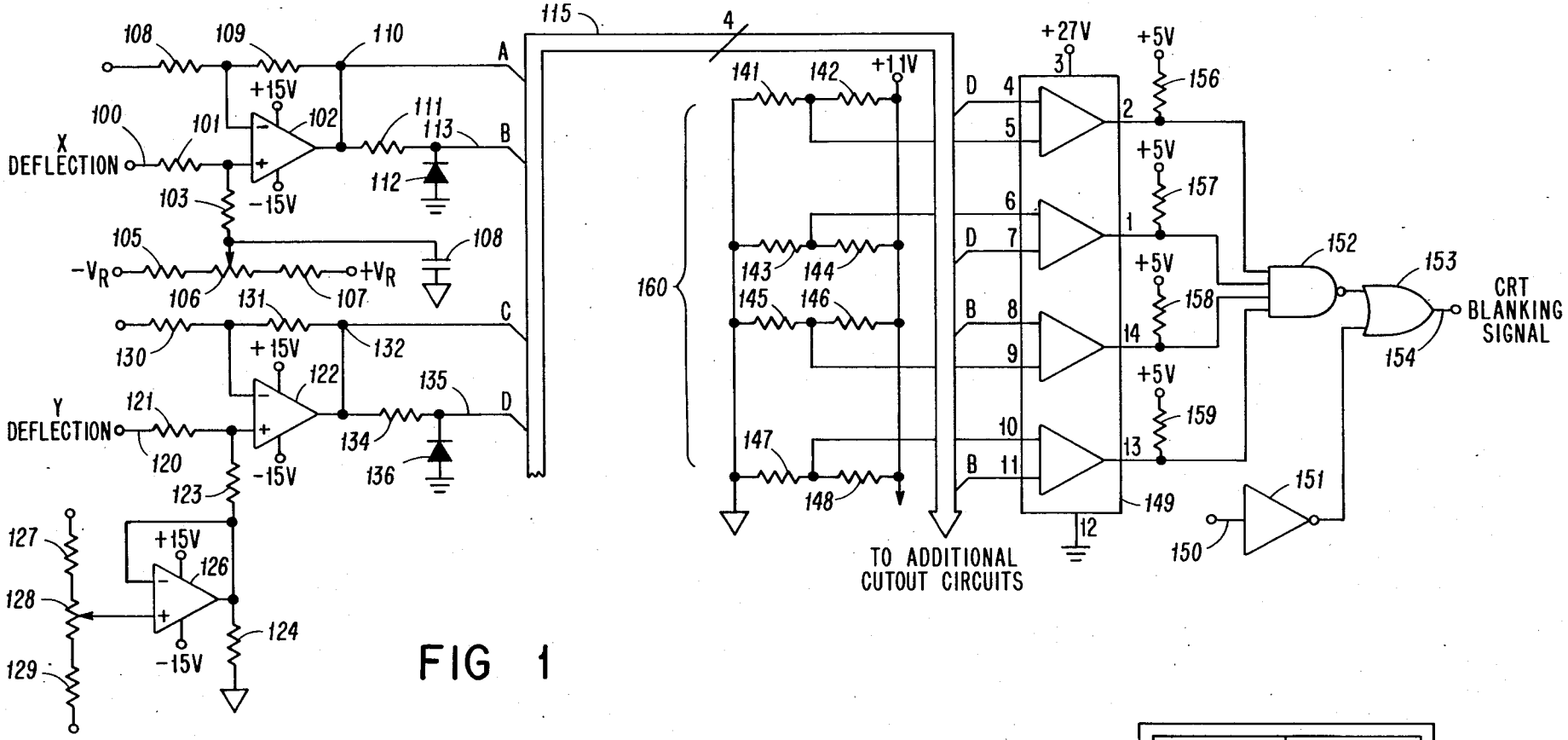
FIG. 1 is a detailed schematic circuit diagram of one embodiment of the present invention in conjunction with a cut-out circuit defining a marker beacon cut-out for a CRT display.

Referring now to FIG. 1, the X and Y deflection voltages are input to the circuitry on lines 100 and 120, respectively. As is known in the art, these voltages, in a raster-scanned cathode ray tube (CRT) fluctuate, in this exemplary embodiment, between ±5 volts. The input resistors 101 and 121 are each 24 kOhms. The X deflection op amp 102, has a +15 volt and a −15 volt power supply and a voltage reference app ied input to the negative input of op amp 102 across resistor 108 (20 kOhms) selected to provide an output voltage shift for the X deflection voltage having a swing from +1 volt to +11 volts at both the A and B outputs of op amp 102 as shown in FIG. 1. The B output across resistor 111 (1 kOhm) is protected by the diode 112 to insure no negative swings are tolerated on output B. Output A is not so protected, and is an accurate representation of the voltage output from op amp 102, provides feedback across resistor 109 (24 kOhms) into the negative terminal of op amp 102. The voltage divider network resistor 105 (33 kOhms), 106 (10 kOhm potentiometer) and 107 (33 kOhms) provides a readily adjustable voltage reference point for shifting the center of the cut-out voltage, with respect to the X deflection voltage, on the CRT screen as desired. The four-line cut-out bus 115 provides communication between the X deflection reference point establishing circuitry and a plurality of cut-out circuits as are required in specific implementations. Capacitor 108 (0.68 mf) shorts high frequencies and thus maintains a filtered DC reference for the X deflection circuitry.

The Y deflection input 120 across resistor 121 is input into an essentially similar circuit to the X deflection reference point establishing circuit previously described with the op amp 122 operating to change a ±5 volt Y deflection input into a +1 to +11 volts output on outputs C and D. Again, one of the outputs (D in this exemplary embodiment) utilizes a protection diode 136 to prevent negative-going signals, in conjunction with resistor 134 (1 kOhm) and a negative voltage reference is coupled across resistor 130 (20 kOhms) with a positive feedback function provided the output of op amp 122 through point 132, and across resistor 131 (24 kOhms) into the negative input terminal of op amp 122.

The additional requirement in the Y deflection reference establishment circuitry for a low impedance input requires an additional op amp 126 in conjunction with the voltage divider circuitry resistor 127 (33 kOhms), resistor 128 (10 kOhm potentiometer), and resistor 129 33 kOhms) allowing a shift in the reference point from ±5 volts to an output range varying at outputs C and D in response to the Y deflection input having a low impedance, enabling through the adjustment of potentiometers 128 and 106, positioning of a voltage reference point for the cut-out circuits to be described generally in the center of the cathode ray tube represented by a 6 volt X deflection voltage on outputs A and B of the cut-out deflection bus 115 as well as a Y deflection voltage of 6 volts on outputs C and D, also on the cut-out deflection bus 115.

Figure 2:
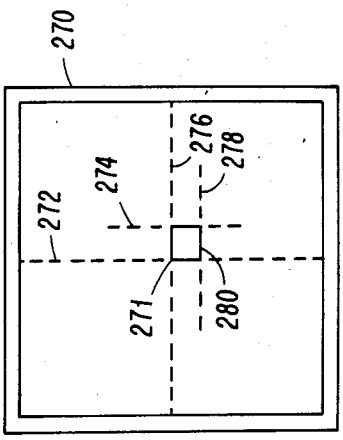
FIG. 2 is a cathode ray tube display showing the marker beacon cut-out form described by the circuitry of FIG. 1.

Thus, any position on the CRT display shown in FIG. 2 is represented by the cartesian coordinates (X, Y) wherein the entire display is described by positive X and positive Y values, and the reference point is established relative to the CRT display by adjusting the X deflection potentiometer 106 and the Y deflection potentiometer 128.

It should be noted that the use of positive X and Y coordinates for the entire surface of the screen enables the coupling of readily available TTL logic circuits to cut-out bus 115. As is known in the art, a negative deflection voltage (by standard convention) is required to deflect the electron beam to the left of the center in the X axis, and the present invention enables that negative voltage to be represented on cut-out bus 115 by a lesser positive voltage. Similarly, a negative Y deflection voltage is represented on cut-out bus 115 as a lesser positive voltage than the reference point, herein established as (+6 volts, +6 volts), and thus logic circuits may be directly coupled to the cut-out bus 115 without additional buffering required.

Referring now to the voltage divider networks 160 of FIG. 1, each of the four shown voltage divider networks are utilized to provide reference voltage for a marker beacon cut-out form as is used in an avionics CRT, for example. The marker beacon circuit described herein is merely exemplary and is described herein to facilitate a readily-understandable example of one of many diverse circuits which may be utilized to define predetermined CRT cut-out forms on the display. Each of the four voltage dividers defines a line as is shown in FIG. 2 on the display which, in combination, define the geometric form of the marker beacon. For example, the voltage divider network resistor 141 (20 kOhms) and resistor 142 (4.93 kOhms) provides a reference voltage on input 5 to the comparator chip 149 (an LM 139) which is compared continuously as the X deflection voltage as modified on cut-out bus 115 is input on line 4. The logic output of the comparator results is output on line 2, to NAND gate 152, thereafter into NOR gate 153. Simultaneously the voltage divider network resistors 143 (20 kOhms) and resistor 144 (7.06 kOhms) provides an additional signal on the NAND gate input 152, and in response to the Y deflection input on cut-out bus 115, to limit the CRT blanking signal output on 154 during periods when the Y deflection is less than the voltage represented by line 278 on the display of FIG. 2 and also when the Y deflection voltage is greater than that represented by line 276 on the display 270 of FIG. 2.

Similarly, the Y deflection voltage is compared by comparator chip 149 for left and right parameters defined by line 272 utilizing the voltage divider circuit resistors 145 (20 kOhms) and 146 (2.03 kOhms) input on line 9 and the voltage divider network resistor 147 (20 kOhms) and resistor 148 (4.17 kOhms) input to comparator chip 149 on line 10. The net result is a blanking signal output on line 154 unless each of the following logic conditions, in the present marker beacon example, are met: (1) the voltage on the deflection cut-out bus for the X axis is greater than that represented by the line 272 shown in FIG. 2; (2) the X deflection voltage is less than the line 274 in FIG. 2; (3) the Y deflection voltage is greater than that represented by line 278; and (4) the Y deflection voltage is less than that represented by line 276 in FIG. 2.

Thus, the CRT 270 has each display point representable by a positive deflection voltage, defined by the reference point establishing circuitry, around an arbitrary reference point defined substantially at the center 271 of display 270. This reference point is adjustable by potentiometers 106, 128, to various equipment and circuit differences as may be encountered, as well as aging of components, and the cartesian coordinates for every point on the surface of the CRT 270 are described on cut-out deflection bus 115 as positive values, enabling direct connection of logic circuits such as comparator chip 149. Thereafter, a variety of cut-out circuits, essentially defining arbitrary forms as may be required in specific implementations are coupled to the cut-out bus to describe specific geometric forms on the display as logic functions embodied in the specific hardware for a specific cut-out form.

By additionally adding circuitry to convert from cartesian to polar coordinates, circles, ovals and combinations of linear, second order and higher equations can be added to cut-out bus 115 to provide additional shapes and locations as desired.

By adding a cut-out circuit defining a first geometric form to a second cut-out circuit output defining a second form, various shapes are readily applied to the display. In the marker beacon example, an additional inverter 151 is coupled between NOR gate 153 and a marker beacon select input 150 to provide the capability of disabling the particular cut-out circuit for the marker beacon as may be desired.

While the present invention has been described with respect to a specific exemplary embodiment, it can be seen that a wide variety of cut-out shapes and corresponding circuits may be added to the cut-out bus and operated essentially simultaneously with additional cut-out circuits, providing a wide variety of capability to the CRT display designer. Additionally, each of the cut-out circuits may be disabled individually and require no software storage memory capability to be implemented. It is therefore contemplated that the appended claims will cover any such modifications or cut-out circuits as fall within the true scope of the invention.

What is claimed is:

1. A circuit for displaying arbitrary forms on a raster scanned cathode ray tube display as a corrdinate function relative to a specified reference point on said display comprising:

a. means, 106, 128 for designating a specified rference point on said display, said reference point having predetermined X and Y deflection voltage constants, respectively;

b. means 102, 122, coupled to said means for designating, for defining an X and Y coordinate system for said cathode ray tube display, wherein each possible location of said specified reference point on said display is represented in the form (positive X, positive Y);

c. means 100, 120 in cooperation with said means for designating and coupled thereto, for sensing operational analog X and Y deflection voltages relative to said reference point voltage constants; and d. means 160, coupled to said means for defining, through comparator means 149, for relating a specified coordinate function, relative to said operational analog X and Y deflection voltages, respectively, and in terms defined by said means for defining, to said specified reference point voltage constants, thereby defining a predetermined form and location on said display.

* * * * *